US006869309B2

(12) United States Patent
Ziegler et al.

(10) Patent No.: US 6,869,309 B2
(45) Date of Patent: Mar. 22, 2005

(54) ENCLOSED BATTERY ASSEMBLY FOR AN UNINTERRUPTIBLE POWER SUPPLY

(75) Inventors: William Ziegler, Reading, MA (US); Michael Lysik, Amesbury, MA (US)

(73) Assignee: American Power Conversion, West Kingston, RI (US)

( * ) Notice: Subject to any disclaimer, the term of this patent is extended or adjusted under 35 U.S.C. 154(b) by 0 days.

(21) Appl. No.: 09/811,856

(22) Filed: Mar. 19, 2001

(65) Prior Publication Data

US 2002/0132519 A1 Sep. 19, 2002

(51) Int. Cl.[7] ..... H01R 11/00
(52) U.S. Cl. ..... 439/504; 439/456
(58) Field of Search ..... 439/504, 456, 439/756, 457, 459; 429/175

(56) References Cited

U.S. PATENT DOCUMENTS 3,456,181 A * 7/1969 Godshalk ..... 439/504
3,617,615 A 11/1971 Balzer ..... 174/87
3,633,154 A 1/1972 Glantz
3,783,436 A * 1/1974 Bury ..... 439/470
4,386,818 A * 6/1983 Millhimes et al. ..... 439/483
4,698,459 A 10/1987 Drake ..... 174/138
4,770,958 A 9/1988 Newman et al. ..... 429/177
5,246,793 A * 9/1993 Scott ..... 429/99
5,348,815 A 9/1994 Barker ..... 429/65
5,389,462 A * 2/1995 Lin ..... 429/121
5,422,198 A * 6/1995 Lin ..... 429/65
5,606,150 A * 2/1997 Radliff et al. ..... 174/92
5,908,714 A * 6/1999 Lund et al. ..... 429/158
5,978,236 A * 11/1999 Faberman et al. ..... 363/37
5,984,718 A * 11/1999 James ..... 439/504
6,010,804 A * 1/2000 Barksdale ..... 429/178
6,120,934 A * 9/2000 Linning et al. ..... 429/175
6,193,543 B1 * 2/2001 Howard et al. ..... 439/459
6,303,248 B1 * 10/2001 Peterson ..... 429/177
6,343,949 B1 * 2/2002 Floyd ..... 439/504

* cited by examiner

*Primary Examiner*—Hae Moon Hyeon
(74) *Attorney, Agent, or Firm*—Mintz, Levin, Cohn, Ferris, Glovsky and Popeo, P.C.

(57) ABSTRACT

An uninterruptible power supply (UPS) system using a battery pack may be potentially hazardous in its design, and in particular when users themselves connect or disconnect the battery from the UPS while the UPS is still active. A battery cap is provided that attaches to the battery to cover parts where the lead wires meet the terminals of the battery.

13 Claims, 4 Drawing Sheets

ENCLOSED BATTERY ASSEMBLY FOR AN UNINTERRUPTIBLE POWER SUPPLY

BACKGROUND OF THE INVENTION

1. Field of the Invention

The present invention pertains to a battery assembly and in particular to a battery assembly in an uninterruptible power supply (UPS) system that protects users from hazardous voltages.

2. Background of the Invention

Users of uninterruptible power supply (UPS) system having battery pack may be subjected to hazardous voltages when users themselves connect or disconnect the battery from the UPS while the UPS is still active. For instance, certain UPS system designs do not use an isolating transformer to isolate high input AC voltage from the UPS circuit. Therefore, a failure of one or more components of the UPS may result in a hazardous condition where high AC voltage is present at the battery leads. Any exposed battery leads or terminals is may expose the user to this dangerous voltage. Furthermore, under various safety standards in various countries, battery connections need to provide protection that meet certain standards such as the Underwriters Laboratories (UL) finger test and the Verband Deutscher Elektringenieure (VDE) probe test. The UL finger test mandates that a human finger should not come in contact with any live parts during normal operation of a device. The VDE probe test requires a specified probe should not be able to touch the active contacts of the battery or its connectors.

Typically, the battery used in the UPS system are generally cells that have metal electrodes and electrolytic liquid, typically sulfuric acid. During battery operation, the electrolysis of water produces Hydrogen and Oxygen gases, which accumulate within the battery. These gases are typically vented through a vent cap that is provided at the battery. Otherwise, accumulation of these gases creates a highly volatile situation and a spark or flame could ignite these gases creating an explosion that can cause serious damage to the UPS system and/or cause injury to a user of the UPS.

Accordingly, it is desired to provide a method and apparatus that resolves these and other shortcomings of UPS systems that use battery packs.

SUMMARY OF THE INVENTION

In one general aspect, the present invention features an uninterruptible power supply for providing AC power to a load. The uninterruptible power supply includes an input to receive AC power from an AC power source, an output that provides AC power, an inverter to receive DC power and to provide AC power, a first connector electrically coupled to the inverter, an energy storage device that provides the DC power, the energy storage device including a plurality of terminals, a plurality of lead wires, each lead wire having a first end connected to one of the terminals of the energy storage device, a second connector adapted to connect to the first connector of the inverter, each lead wire having a second end connected to the second connector, an energy storage device cap attached to the energy storage device and covering the terminals and the first end of each of the lead wires, and a transfer switch constructed and arranged to select one of the AC power source and the energy storage device as an output power source for the uninterruptible power supply.

Other features may include one or more of: a portion of the energy storage device cap is configured to provide strain relief to the lead wire; the strain relief portion of the energy storage device cap is a plurality of posts in which a lead wire can be weaved; the energy storage device cap is made of an insulating material; the energy storage device cap provides impact protection to the terminals of the energy storage device; the first and second connector are constructed to mate without a use of a tool; an insulating tube formed around the plurality of lead wires of the energy storage device; and a shrink wrap material that attaches the energy storage device cap to the energy storage device.

In another general aspect, the uninterruptible power supply includes an input to receive AC power from an AC power source, an output that provides AC power, an inverter to receive DC power and to provide AC power, a first connector electrically coupled to the inverter, an energy storage device that provides the DC power and having a second connector to connect to the first connector of the inverter, the energy storage device having a plurality of terminals and a plurality of leads wires, a first end of each of the lead wires connected to one of the terminals, means for covering the terminals and the first end of each of the lead wires, and a transfer switch constructed and arranged to select one of the AC power source and the energy storage device as an output power source for the uninterruptible power supply. Other features may include means for attaching the means for covering the energy storage device.

In another general aspect, a method pertains to constructing an uninterruptible power supply for providing AC power to a load. The method includes providing an input to receive AC power from an AC power source, providing an output that provides AC power, providing an inverter to receive DC power and to provide AC power, providing a first connector to the inverter, providing an energy storage device that provides the DC power, wherein the energy storage device is formed by providing a plurality of terminals, attaching a first end of each lead wire in a plurality of lead wires to one of the terminals of the energy storage device, providing a second connector adapted to connect to the first connector of the inverter, connecting a second end of each lead wire of the plurality of lead wires to the second connector, attaching an energy storage device cap to the energy storage device, the cap covering the terminals and the first end of each of the lead wires, and providing a transfer switch constructed and arranged to select one of the AC power source and the energy storage device as an output power source for the uninterruptible power supply.

Other features may include one or more of: forming a strain relief for the lead wires in a portion of the energy storage device cap; using an insulating material to form the energy storage device cap; mating the first and second connectors without use of a tool; forming an insulating tube around the plurality of lead wires of the energy storage device; and using a shrink wrap to attach the energy storage device cap to the energy storage device.

DETAILED DESCRIPTION

Embodiments of the invention are described below with reference to an uninterruptible power supply (UPS) battery assembly. As understood by those skilled in the art, the method and apparatus described may be used for manufacturing a battery assembly that may be used for other purposes.

Figure 1:
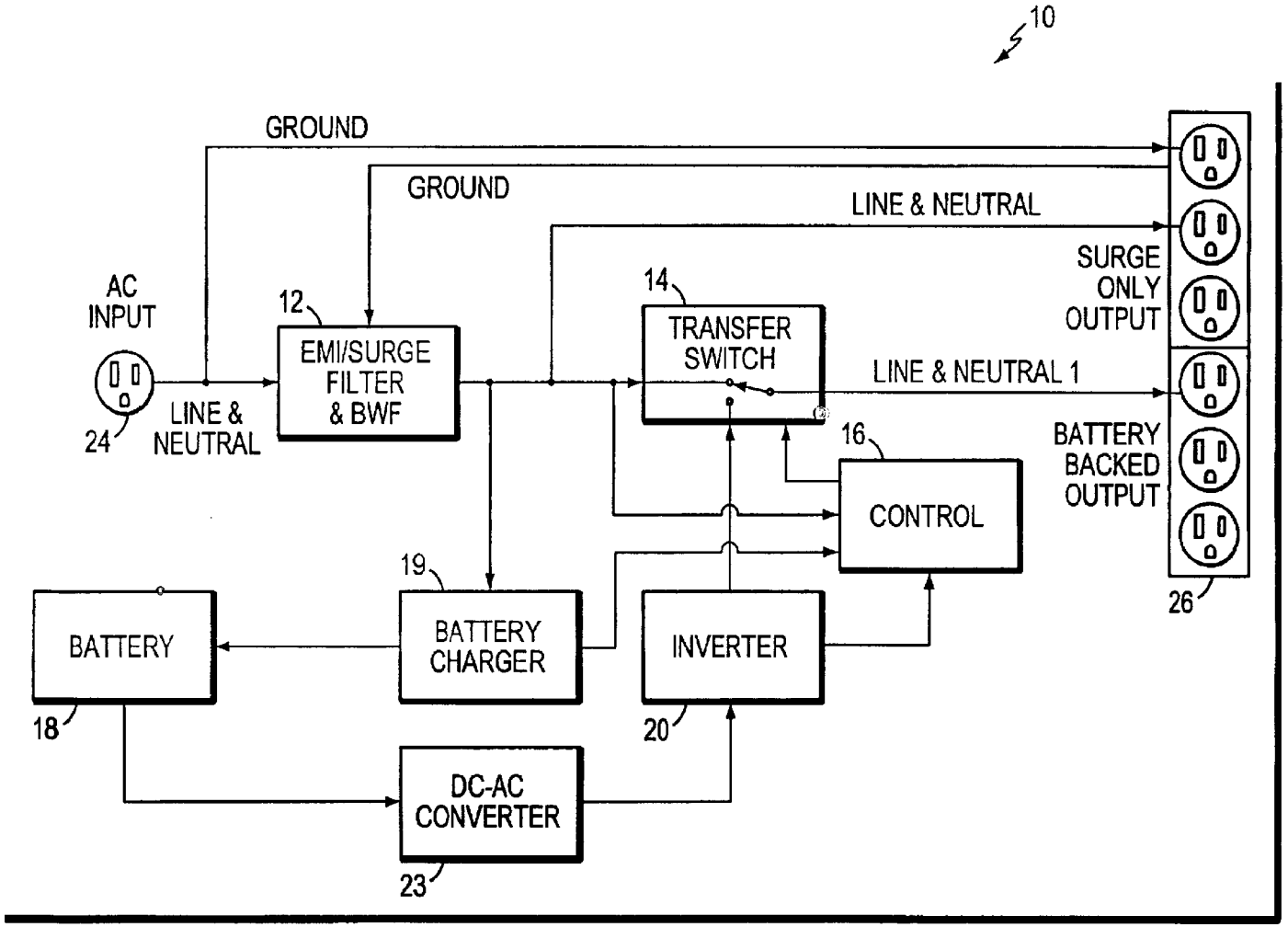
FIG. 1 PRIOR ART
FIG. 1 is a block diagram of a typical uninterruptible power supply (UPS)

The use of uninterruptible power supplies (UPSs) having battery back-up systems to provide regulated, uninterrupted power for sensitive and/or critical loads, such as computer systems, and other data processing systems is well known. FIG. 1 shows a typical prior art UPS 10 used to provide regulated uninterrupted power. The UPS 10 includes an input filter/surge protector 12, a transfer switch 14, a controller 16, a battery 18, a battery charger 19, an inverter 20, and a DC-DC converter 23. The UPS also includes an input 24 for coupling to an AC power source and an outlet 26 for coupling to a load.

The UPS 10 operates as follows. The filter/surge protector 12 receives input AC power from the AC power source through the input 24, filters the input AC power and provides filtered AC power to the transfer switch and the battery charger. The transfer switch 14 receives the AC power from the filter/surge protector 12 and also receives AC power from the inverter 20. The controller 16 determines whether the AC power available from the filter/surge protector is within predetermined tolerances, and if so, controls the transfer switch to provide the AC power from the filter/surge protector to the outlet 26. If the AC power from the rectifier is not within the predetermined tolerances, which may occur because of "brown out," "high line," or "black out" conditions, or due to power surges, then the controller controls the transfer switch to provide the AC power from the inverter 20. The DC-DC converter 23 is an optional component that converts the output of the battery to a voltage that is compatible with the inverter. Depending on the particular inverter and battery used the inverter may be operatively coupled to the battery either directly or through a DC-DC converter.

The inverter 20 of the prior art UPS 10 receives DC power from the DC-DC converter 23, converts the DC voltage to AC voltage, and regulates the AC voltage to predetermined specifications. The inverter 20 provides the regulated AC voltage to the transfer switch. Depending on the capacity of the battery and the power requirements of the load, the UPS 10 can provide power to the load during brief power source "dropouts" or for extended power outages.

Figure 2:
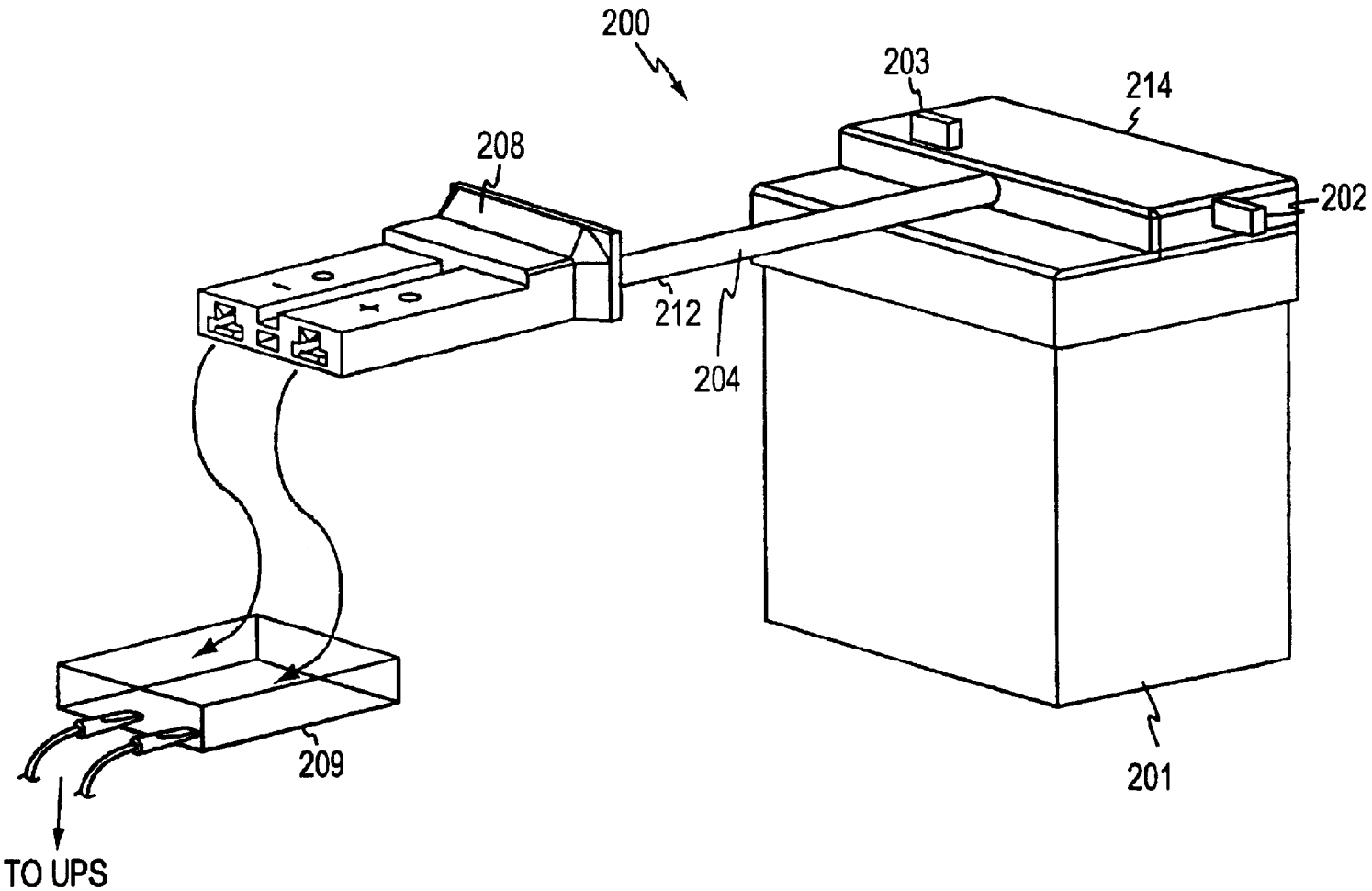
FIG. 2 is a battery assembly configured in accordance with an embodiment of the invention.

FIG. 2 shows a battery assembly 200 that may be used as the battery 18 in the UPS 10 of FIG. 1. The battery assembly 200 comprises a battery 201, lead wires 204, a male connector 208 and a battery cap 214. The battery 201 may be of a conventional type that is used in a UPS system and has a positive terminal 202 and a negative terminal 203. Each of the lead wires 204 has a first end attached to one of the terminals 202, 203 using a variety of known methods such as terminal locks at the end of the lead wires that lock onto the terminals or the lead wires are simply soldered on to the terminals 202, 203. The lead wires 204 leading away from the battery 201 are contained within an insulator tube 212. The insulator tube provides supplemental insulation (such as double-insulation) of the lead wires as well as lead wire management by holding the positive and the negative leads together. Each of the lead wires has a second end that is terminated at a male connector 208.

The male connector 208 is designed such that contacts within the male connector 208 cannot be contacted by a finger. The male connector 208 is keyed to polarize a connection with a female receiver connector 209 located within the UPS. Because hazardous voltage may be present at female receiver connector 209, according to one embodiment, the female receiver connector 209 needs to conform to the VDE probe test. One method of conforming to the VDE probe test is to provide a 5 mm clearance from a VDE probe to the contacts within the female receiver connector 209. The male connector 208 and the female connector 209 are designed for easy mating with each other and do not require any tools for connection. This feature is an improvement over known battery connectors that typically require a tool to connect them to the UPS. It should be noted that the positioning of the female connector of the UPS and the male connector of the battery are interchangable.

The battery cap 214 is welded, adhered with epoxy or mechanically strapped to the battery 201 to cover the area where the lead wires 204 meet the terminals 202, 203. The battery cap 214 may be molded to fit the contour of the battery 201 and preferably, the battery cap 214 is designed to fit batteries from multiple vendors and therefore is universal in its design to reduce complexity and cost. The material used to manufacture the battery cap 214 is preferably one with insulating properties such as thermoplastics or thermosets. The battery cap 214 seals the terminal connecting end of the leads wires 204 and the terminals 202, 203 to prevent access by the user to protect the user from potentially hazardous voltages at the lead wires and terminals. The battery cap 214 may also serve as an impact protector for the terminals 202, 203 of the battery 201.

A second embodiment of a battery assembly 300 will now be described with reference to FIG. 3. the battery cap 314 is adhered to the battery 301 using a piece of commercially available plastic shrink tubing 316 that shrink wraps around the battery assembly 300. However, it should be noted that the battery cap may be welded or adhered with epoxy to the battery and a shrink wrap is placed around the combination. Typically, the plastic shrink tubing 316 is thermally sensitive and shrinks when heat is applied to it. Because of the insulating nature of the plastic shrink tubing 316, it provides an additional protection layer on the battery assembly 300. Furthermore, because the shrink tubing 316 wraps tightly around the contour of the battery cap 314 and the battery 301 a simple but effective attachment of the battery cap to the battery is formed. The battery cap 314 has a plurality of vents 318 that provide discharge of Hydrogen and Oxygen gases that accumulate during battery operation. The vents 318 eliminate a potential hazard that occurs when an explosive combination of Hydrogen and Oxygen gases are present. To ensure that the vents 318 operate properly, the vents 318 should not be sealed or covered by the shrink wrap during the shrink wrap process.

Figure 3:
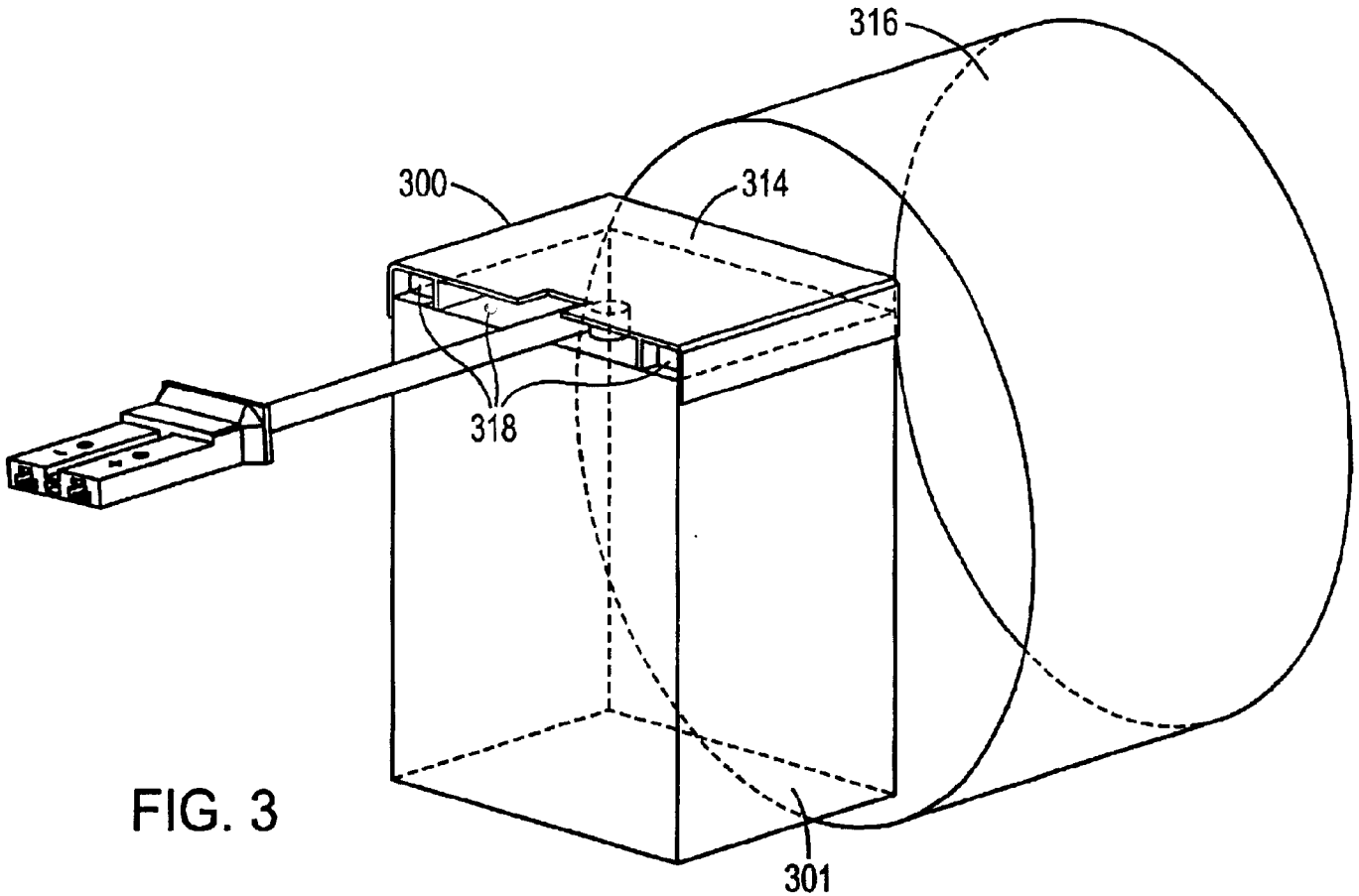
FIG. 3 is another battery assembly configured in accordance with an embodiment of the invention.
Figure 4:
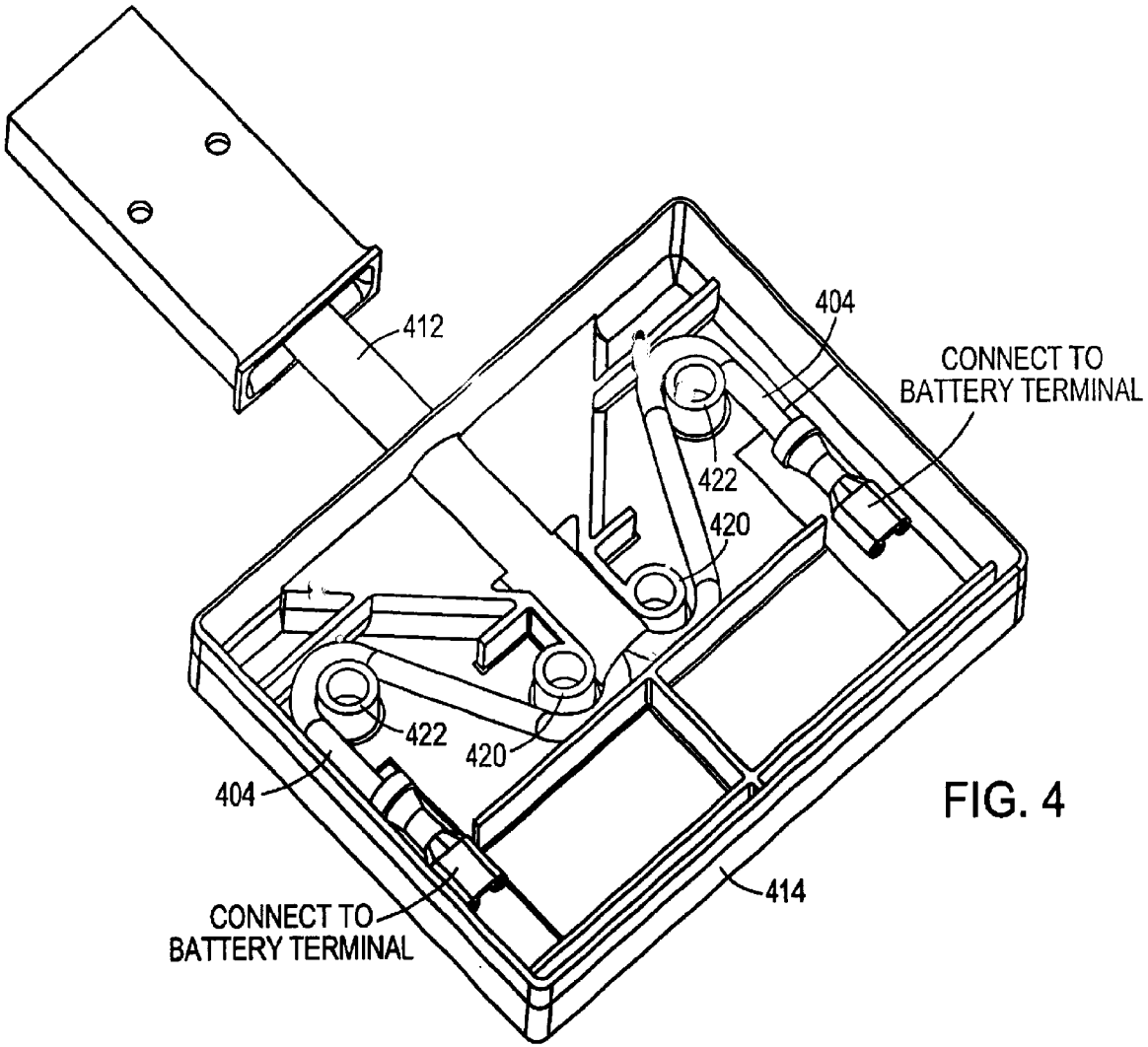
FIG. 4 is a bottom view of a battery cap in accordance with an embodiment of the invention showing strain relief posts.

FIG. 4 shows a bottom view of a battery cap 414 in accordance with an embodiment of the invention which may be implemented in the battery caps illustrated in FIG. 2 and FIG. 3. The battery cap 414 has a strain relief portion 420, 422 that, in one embodiment comprises a plurality of posts in which each of the lead wires 404 can be woven or wrapped around. An insulator tube 412 containing the lead wires 404 enters through an opening of the battery cap 414. Each lead wire 404 is wrapped around a first post 420 and a second post 422 forming an "S" shape around the posts 420, 422. The end of the lead wire 404 is connected to the terminal of the battery (not shown). The strain relief portion 420, 422 allows the lead wires to be pulled without exerting pressure on the leadwire-battery terminal connection. In one embodiment, the strain relief portion is designed to be able to absorb a pull force of 100 Newtons on the lead wires 404.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The scope of the invention should be defined by the following claims and the equivalents thereof.

What is claimed is:

1. An uninterruptible power supply for providing AC power to a load, the uninterruptible power supply comprising:

an input to receive AC power from an AC power source;

an output that provides AC power;

an inverter to receive DC power and to provide AC power;

a first connector electrically coupled to the inverter;

an energy storage device that provides the DC power, the energy device including:

a plurality of terminals;

a plurality of lead wires, each lead wire having a first end connected to one of the terminals of the energy storage device;

a second connector adapted to connect to the first connector, each lead wire having a second end connected to the second connector;

an energy storage device cap attached to the energy storage device and covering the terminals and the first end of each of the lead wires, wherein the energy storage device cap has a housing that forms an opening through which the plurality of lead wires pass, wherein an underside of the energy storage device cap is constructed and arranged to provide paths to route the plurality of lead wires to the plurality of terminals, and wherein the energy storage device cap includes at least one strain relief portion that provides strain relief for each of the plurality of lead wires; and a transfer switch constructed and arranged to select one of the AC power source and the energy storage device as an output power source for the uninterruptible power supply.

2. The uninterruptible power supply as in claim 1 wherein the strain relief portion of the energy storage device cap is a plurality of posts in which a lead wire can be weaved.

3. The uninterruptible power supply as in claim 1, wherein the energy storage device cap is made of an insulating material.

4. The uninterruptible power supply as in claim 1, wherein the energy storage device cap provides impact protection to the terminals of the energy storage device.

5. The uninterruptible power supply as in claim 1, wherein he first and second connector are constructed to mate without a use of a tool.

6. The uninterruptible power supply as in claim 1, further comprising:

an insulating tube formed around the plurality of lead wires of the energy storage device.

7. The uninterruptible power supply as in claim 1, further comprising:

a shrink wrap material that, when heated, attaches the energy storage device cap to the energy storage device.

8. An uninterruptible power supply for providing AC power to a load, the uninterruptible power supply comprising:

an input to receive AC power from an AC power source;

an output that provides AC power;

an inverter to receive DC power and to provide AC power;

a first connector electrically coupled to the inverter;

an energy storage device that provides the DC power, the energy storage device having a plurality of terminals and a plurality of leads wires, a first end of each of the lead wires connected to one of the terminals;

housing means for covering the terminals and the first end of each of the lead wires, the housing means forming an opening for receiving the plurality of lead wires and including means for routing each of the lead wires to one of the plurality of terminals and means constructed and arranged along an underside of the housing means for providing strain relief for each of the plurality of lead wires; and a transfer switch constructed and arranged to select one of the AC power source and the energy storage device as an output power source for the uninterruptible power supply.

9. A method of installing a battery into an uninterruptible power supply, the uninterruptible power supply having a first connector to couple to a battery, the method comprising:

providing a battery having a first terminal and a second terminal;

providing a battery cap having an underside that contacts a top portion of the battery, and having a pair of lead wires integrated into the battery cap, the lead wires being contained in paths formed in the underside of the battery cap and passing out of the battery cap and terminating in a second connector;

installing the battery cap on the battery such that each wire of the pair of lead wires mates with one of the first terminal and the second terminal;

installing the battery into the uninterruptible power supply and mating the first connector with the second connector.

10. The method of claim 9, wherein the mating of the first connector and the second connector is accomplished without the use of a tool.

11. The method of claim 9, further comprising routing each wire of the pair of wires through a separate path in the battery cap.

12. The method of claim 9, further comprising containing a portion of the pair of wires between the housing and the second connector in an insulating sleeve.

13. The method of claim 9, further comprising routing each wire of the pair of wires through a hole formed in a housing of the battery cap.

* * * * *